United States Patent [19]

Johnson

[11] Patent Number: 4,666,035

[45] Date of Patent: May 19, 1987

[54] BATTLEFIELD MAGAZINE WITH EXTERNAL REINFORCING FRAME

[75] Inventor: Bruce S. Johnson, Dallastown, Pa.

[73] Assignee: Harsco Corporation, Wormleysburg, Pa.

[21] Appl. No.: 802,469

[22] Filed: Nov. 27, 1985

[51] Int. Cl.[4] ..... F42B 37/00

[52] U.S. Cl. ..... 206/3; 89/36.01; 109/49.5; 220/72; 220/74; 206/443

[58] Field of Search ..... 206/3, 443; 89/36 R, 89/36 D, 37 R; 109/49.5; 220/72, 71, 74

[56] References Cited

U.S. PATENT DOCUMENTS

| | | | |
|---|---|---|---|
| 2,094,009 | 9/1937 | Goebert . | |
| 2,170,525 | 8/1939 | Ball . | |
| 2,358,915 | 9/1944 | Duthie . | |
| 2,371,663 | 3/1945 | Woodberry et al. | 206/3 |
| 2,392,675 | 1/1946 | Lamb | 206/3 |
| 2,670,984 | 3/1954 | Arthur | 206/3 |
| 2,774,474 | 12/1956 | Phillips | 206/3 |
| 3,160,060 | 12/1964 | Zsoka et al. . | |
| 3,202,295 | 8/1965 | Drader . | |
| 3,327,896 | 6/1967 | Asenbauer . | |
| 3,379,339 | 4/1968 | Asenbauer . | |
| 3,424,334 | 1/1969 | Goltz . | |
| 3,438,544 | 4/1969 | Cloyd . | |
| 3,939,967 | 2/1976 | Tenney et al. | 206/3 |
| 4,344,528 | 8/1982 | Perisastry et al. . | |
| 4,440,296 | 4/1984 | Howe et al. | 206/3 |
| 4,476,988 | 10/1984 | Tanner . | |
| 4,538,723 | 9/1985 | Johnson et al. | 206/3 |

FOREIGN PATENT DOCUMENTS

| | | |
|---|---|---|
| 1578137 | 7/1971 | Fed. Rep. of Germany . |
| 11498 | 8/1915 | United Kingdom . |

*Primary Examiner*—Joseph Man-Fu Moy

*Attorney, Agent, or Firm*—Kerkam, Stowell, Kondracki & Clarke

[57] ABSTRACT

A battlefield magazine, for protecting a plurality of projectiles against harsh environmental conditions, includes a molded base for holding back portions of a plurality of projectiles. A steel frame assembled to the molded base provides structural strength and support to the molded base. A cover, attaches to the steel frame and molded base assembly and protectively encloses the front one-half of the ogives of the projectiles extending out from the front of the molded base. Reinforcing plates, positioned on the back surface of the molded base provide structural strength during vertical lifting of the battlefield magazine. The frame and reinforcing plates include lugs on one side while the corresponding opposite sides include recesses adapted to receive lugs of a like magazine to allow stacking of magazines.

20 Claims, 4 Drawing Figures

FIG. 1.
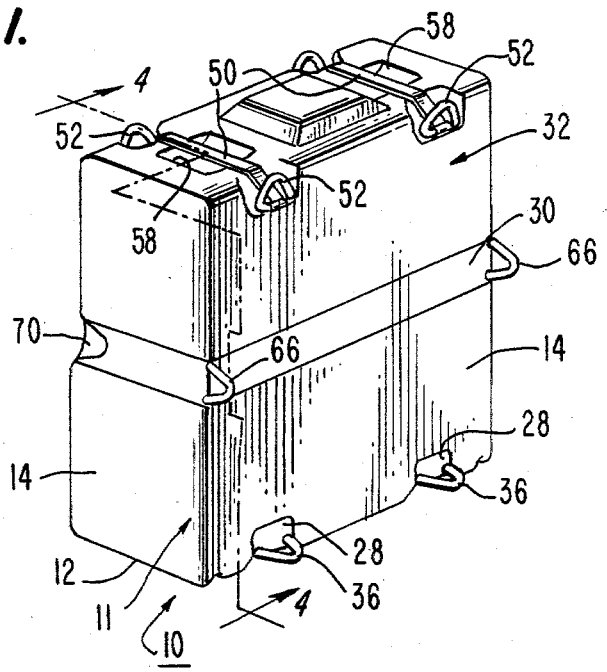
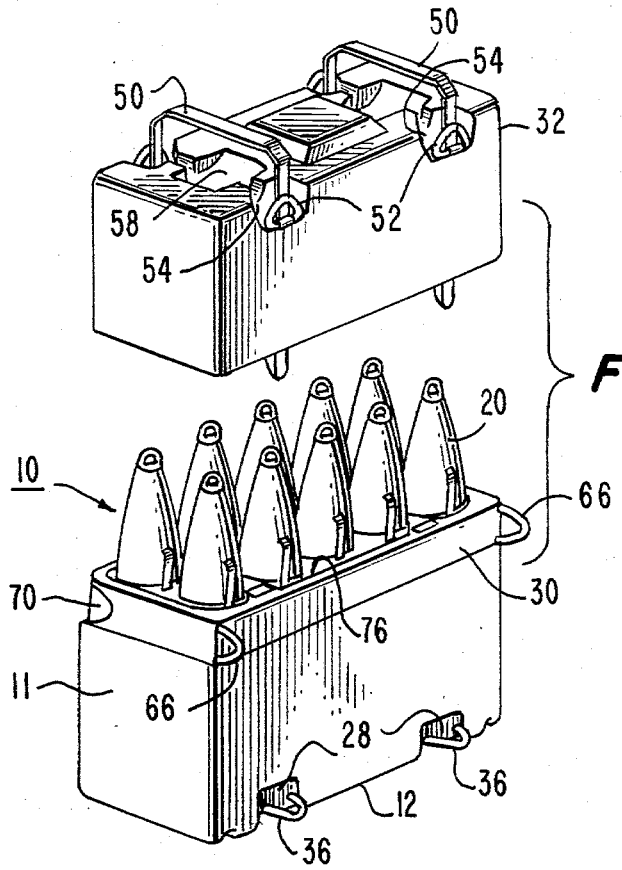
FIG. 2.

BATTLEFIELD MAGAZINE WITH EXTERNAL REINFORCING FRAME

BACKGROUND OF THE INVENTION

The present invention relates to magazines for carrying and/or storing projectiles and in particular to a battlefield magazine having an external reinforcing frame.

The modern war is often a war of logistics where the winner is determined by the ability to efficiently transport men and material. Accordingly, it is essential to optimize the conveyance of ammunition such as projectiles and shells.

For simplicity, "projectiles" as used herein shall be considered to include shells, missiles, torpedoes, bombs, and more generally ammunition.

The storage or transportation of projectiles generally requires a balancing between two conflicting considerations. On the one hand, the projectiles should be stored such that it is easy to remove them from their storage mechanism as required for usage of the projectiles. On the other hand, the projectiles must be stored such that they are secure in their storage arrangement and will not be jarred loose by nearby explosions or while being transported along a bumpy road. Generally, the more secure a projectile is from accidental dislodgement, the more time-consuming it is to remove the projectile from its storage facility.

Other factors to be considered in the storage or transportation of projectiles is the need to not only protect the projectiles from damage but to provide devices to aid in the compact storage of the projectiles. In addition, there is a need to provide for easy lifting and conveying of one or a number of projectiles in a protective enclosure.

One common method for transportation and storage of projectiles is by use of a wooden pallet. The pallet is normally configured in two rows of four projectiles. The wooden pallet consists of upper and lower wood laminates held together with steel banding. The bases of the projectiles rest on the lower wood laminate board and the nose protrudes through holes drilled in the top wood laminate board.

The use of wooden pallets is subject to numerous disadvantages. For one thing, the steel banding must be cut or otherwise removed to allow access to all of the projectiles, this in turn necessitating the rebanding of the wooden pallet if the projectiles are to be resecured. Further, the pallet does not protect the projectiles from incidental mechanical damage or from a contaminated environment (storage under high humidity or other harsh conditions or nuclear, biological, or chemical agents). Accordingly, the projectiles require periodic maintenance at considerable expense or likewise expensive decontamination where enemy action has resulted in nuclear, biological, or chemical agents contaminating the outside of the projectiles. In order to maintain or decontaminate the projectiles, the pallet must be broken apart. The projectiles must then be treated to protect them from environmental deterioration and/or to decontaminate them. The projectiles must then be replaced upon the pallet and the upper and lower boards of the pallet must be rebanded together.

A further disadvantage of the wooden pallet method is that the projectiles must be removed from the pallets in order to allow them to be readied for usage by placement within an ammunition resupply vehicle such as that disclosed in the U.S. Pat. No. 4,236,441 entitled "Field Artillary Ammunition Support Vehicle" issued on Dec. 2, 1980 to John Turner, Richard A. Koster, and Seymour Bassman, and assigned to the assignee of the present application.

Some of the prior art problems with storage and transportation of projectiles have been overcome by the Projectile Lock Assembly disclosed in U.S. Pat. No. 4,344,528, issued Aug. 17, 1982 to Ayyala Perisastry, Richard A. Vishe, and Peter J. Hoet. The projectile lock assembly disclosed in that patent, which is assigned to the assignee of the present invention, uses a track having a plurality of parallel cylindrical tubes. A number of locking assemblies are mounted along each of the tubes and used for individually locking projectiles within the associated tube.

The projectile lock assembly of the Perisastry et al patent is extremely useful in providing a storage rack for projectiles. Its structure is complex, but it is most practical under conditions where projectiles must be separately removed from a storage rack. That is, it is advantageous in an ammunition resupply vehicle of the type shown in U.S. Pat. No. 4,236,441 where projectiles must be normally secured during the vehicle's movement and selectively removed from projectile storage zones as necessary for conveyance to a self propelled howitzer or other weapon. However, the expense and complexities of the locking structure generally would preclude its use for transportation of projectiles except where individual projectile access is required (i.e., at or near the battlefront where projectiles are fused and/or loaded into weapons).

As will be readily appreciated, the transfer of projectiles from a wooden pallet to the projectile rack and lock assembly adds a time consuming step to the overall process of most efficiently getting projectiles from the factories and/or long term depots to the racks from which the projectiles may be stored and conveyed under battlefield conditions.

OBJECTS AND SUMMARY OF THE INVENTION

Accordingly, it is a primary object of the present invention to provide a new and improved battlefield magazine.

A more specific object of the present invention is to provide an improved battlefield magazine which may be used for projectile storage and conveyance under front line conditions as well as long term storage.

A further object of the present invention is to provide an improved battlefield magazine which will protect projectiles from deterioration under harsh environmental conditions such as high humidity and which will protect projectiles from contamination due to enemy action by way of nuclear, chemical, and biological agents.

Yet another object of the present invention is to provide an improved battlefield magazine which is easy to operate for securing and releasing projectiles as desired.

A still further object of the present invention is to provide a battlefield magazine which can be horizontally stacked and lifted by externally protruding lifting lugs.

Still yet another object of the present invention is to provide an improved battlefield magazine which is structurally reinforced to hold heavy projectiles in a horizontal or vertical position.

Another object of the present invention is to provide a multiple chamber molded battlefield magazine having a self latching mechanism for retaining projectiles in each chamber and which may provide a completely enclosed container during storage and transportation.

In accordance with the above and other objects of the present invention, there is provided a battlefield magazine having a molded base and a plurality of compartments or chambers for holding and storing a plurality of projectiles, one in each chamber. An external steel frame is assembled to the molded base for structural strength and support. A molded cover may be attached to the molded base assembly for enclosing the front one-half of the ogives of the projectiles extending out from the front of the molded base. Individual locking mechanisms are built into each chamber for retaining projectiles.

In accordance with the present invention, the battlefield magazine comprises two major parts, a molded plastic base and a cover. The base holds a plurality of projectiles and can be stacked to form projectile racks. The cover can be installed or removed while the base is in its stacked position. A metal reinforcing frame surrounds the plastic base molding at one end and is joined to the base during final assembly.

The molded base of the battlefield magazine includes a body having a plurality of storage compartments and defined by a front portion, a back or base surface including a pair of elongated transverse recesses, four sides extending from the back surface to the front portion or top section. The top section is molded to form entries to the compartment and has an overall reduced diameter and transverse channels to enable assembly of the external reinforcing frame. The projectiles are held secure in a plurality of cylindrical projectile storage compartments or chambers formed in the body and having parallel center lines. Each projectile storage compartment is of circular cross-section and has a length and transverse dimension to be operable to hold a projectile with at least one-half of the ogive of the projectile extending out from the front surface of the molded base. An individual locking mechanism is built into each chamber for securely locking each projectile within the chamber.

The battlefield magazine also includes two reinforcing plates, each positioned in an elongated transverse recess provided on the back surface of the molded base. The reinforcing plates provide structural strength and support during vertical lifting of the battlefield magazine. The reinforcing plates have a pair of tension rods threaded at one end and which extend through a pair of corresponding holes in the molded body and the steel frame. The reinforcing plates and the steel frame are secured to the molded body by fasteners placed on the threaded ends of the tension rods.

BRIEF DESCRIPTION OF THE DRAWINGS

The above and still further objects, features and advantages of the present invention will become apparent upon consideration of the following detailed description of specific embodiments thereof, especially, when considered in conjunction with the accompanying drawings wherein like parts of each of the several figures are identified by the same reference numerals, and wherein:

FIG. 1 is diagrammatic view in perspective of the battlefield magazine of the present invention;

FIG. 2 is a diagrammatic exploded view in perspective of the present invention showing the cover of the battlefield magazine removed from its molded base;

DESCRIPTION OF THE PREFERRED EMBODIMENT

Figure 3:
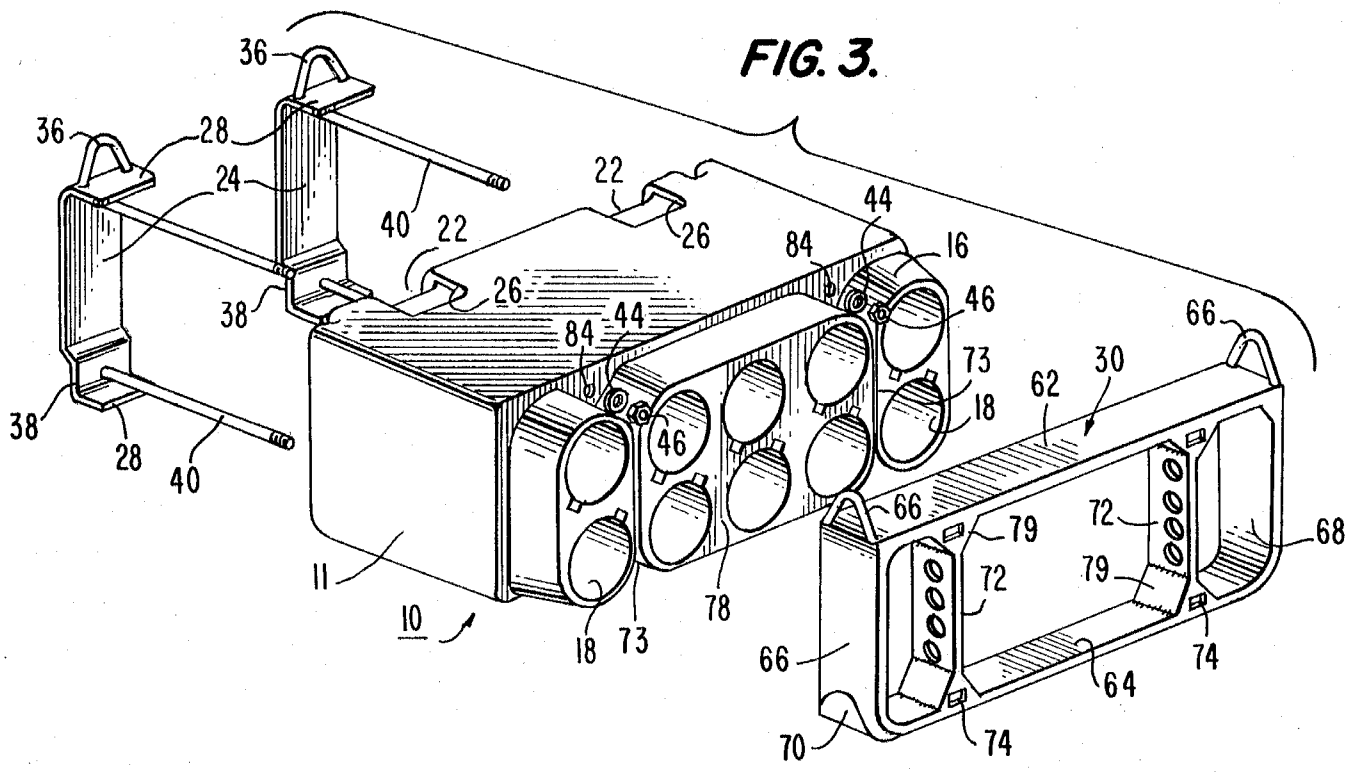
FIG. 3 is an exploded perspective view of the base assembly of the present invention.

Referring to the drawings and particularly to the illustrations of the invention of FIGS. 1, 2 and 3, the battlefield magazine 10 includes a molded base 11 having a back or base surface 12, four sides 14 extending upwardly from the base surface 12 and a top section 16 recessed and tapering inwardly from the four sides. The base is molded with top entries for a plurality of internal projectile storage compartments or chambers 18, each of which receives an individual projectile 20. The base surface 12 includes a pair of elongated transverse recesses or grooves 22, adapted to receive wrap around reinforcing plates 24. Grooves 22 are molded such that the grooves extend partly upward in the sides of the molded base 11 as at 26 to receive the end sections 28 of plates 24.

The molded base 11 can be made of plastic or any other moldable material and, as illustrated in FIG. 2, is designed to receive the cylindrical back or shell portion of a plurality of projectiles 20 within a corresponding plurality of projectile storage chambers 18 arranged with parallel center lines. Each projectile storage chamber is of circular cross-section and has a length and transverse dimension to be operable to hold a projectile with at least one-half of the length of the ogive of the projectile extending out from the top surface of the molded base.

In accordance with the present invention, the battlefield magazine further includes a wraparound steel reinforcing frame 30 assembled to and surrounding the top section 16 of the molded base 11. A cover 32 is arranged to be attached to the steel frame 30 and molded base assembly by a latching device 34 shown best in FIG. 4 which transfers lifting forces through the frame 30 to the reinforcing plates 24 positioned within the transverse recesses 22 in the surface 12 of the molded base.

Figure 4:
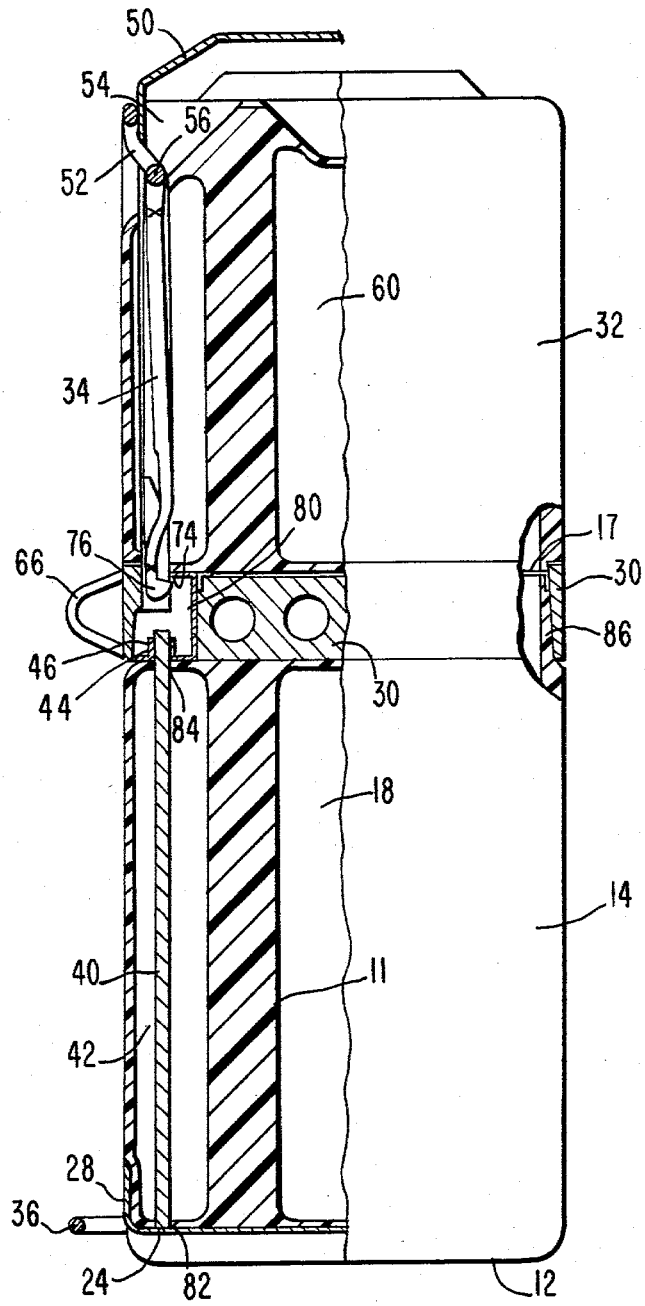
FIG. 4 is a side elevational view, partially in section, of the present invention with a cover attached to the molded base.

The reinforcing plates 24 are identical in construction. Thus, only one plate is shown. Each plate 24 includes a plate lifting lug 36 extending outward from an end 28 of the reinforcing plate 24 for providing a lifting point. The other end of plate 24 is raised as at 38 to provide a pocket or recess in the reinforcing plate 24 opposite the plate lifting lug for receiving a plate lifting lug from a second adjacent stacked battlefield magazine. This not only allows stacking of units, but provides positive indexing during stacking of like battlefield magazine units. The transverse grooves 22 in surface 12 of the base unit 11 are parallel to each other and extend from a first side of the molded base to a second side of the molded base opposite the first side. In addition, the grooves 24 continue upwardly a short distance from surface 12 up onto the first and second sides 14 of the molded base so that the ends 28 of the plate rests snugly against the outer surface of the base. To this end, the plate 24 is provided with corresponding right angle bends 28 at opposite ends that are received in the upwardly extending recesses. In this manner, the supporting straps or plates cradle and wrap around the base unit, the dimensions being such that the plates snugly fit into the molded grooves along the bottom and side of the molded base unit. A pair of tension rods 40 welded to each plate 24 extend upwardly from the plates and are adapted to pass through associated elongated through passages 42 provided in the molded base unit. The rods 40 are threaded at the free end and are a length sufficient to allow the threaded ends to clear the through passages for application of fastening devices which may comprise a washer 44 and nut 46 as shown in FIG. 4 by which the plates are tightly secured against the molded body.

The molded cover 32 includes a pair of handles 50 arranged for conveniently removing the cover of the battlefield magazine or locking the cover in place in a manner to be hereinafter described. Lifting lugs 52 each situated in a corresponding molded recess 54 in the top of the cover protrude from the cover 32 adjacent opposite ends of the handle 50 for providing lifting points. Latching device 34, best shown in FIG. 4, is pivotally attached to the inner surface of the cover 32 as at 56 and serves to lock cover 32 in place to the steel frame and molded base assembly. Latching device 34 is of the type shown in U.S. Pat. No. 4,538,723, the subject matter of which is incorporated herein by reference and need not be described in detail herein.

The cover 32 further includes cover recesses 58, as shown in FIG. 1, formed into the top of the cover under the handles 50 for providing a clearance to allow hand gripping of the handles 50. The cover 32 is designed to enclose the front one-half ogives of the projectiles extending out from the front surface of the molded base 11 as best shown in FIG. 2 and to this end includes multiple ogive chambers 60 corresponding to the positions of the projectile chambers 18.

The steel reinforcing frame 30 includes a left side frame member 62, a right side frame member 64 disposed opposite the member 62 and first and second frame ends 66 and 68 connecting corresponding frame members 62 and 64. Frame lifting lugs 66 protrude from opposite ends of the one side (the side from which lugs 6 extend from the lugs) of the steel frame for providing lifting points. Pockets or recesses 70 are formed into the first and second frame ends at points opposite the lifting lugs 66. The steel frame 30 further includes a pair of parallel cross tension straps 72, within the rectangular open frame. Straps 72 connect between the frame member 62 of the steel frame and the frame member 64 for additional structural strength and support to the battlefield magazine during lifting. Additionally, through openings 74 are provided in each of the cross straps 72 adjacent the first and second sides at the points of connection between the cross straps 72 and the first and second sides 62 and 64. The openings 74 receive the hook end 76 of latching device 34 which hooks the steel frame 30 thereby attaching the cover 32 to the steel frame 30 and molded base assembly 11. The frame recesses 70 are located so as to receive frame lifting lugs from a second battlefield magazine to accomplish positive indexing during horizontal stacking of the battlefield magazines. The steel frame 30 provides structural strength and added support to the battlefield magazine during transport and storage of the loaded battlefield magazine.

It will be readily apparent however, from FIG. 2, that when loaded, a plurality of projectiles 20 with at least one-half of the ogives of the projectiles extend out from and above the top surface 78 of the molded base 11. In the preferred embodiment, as shown in FIG. 3 ten projectile storage compartments 18 are provided, each having a circular cross-section and arranged into two equal rows of five. The projectile storage compartments extend from the front surface 78 into the molded base a length operable to hold the projectile having at least one-half of the ogive of the projectile extending out the front surface of the molded base. The steel frame 30 is assembled to the tapered top section 16 of the molded base with straps 72 passing between grooves 73 inwardly adjacent each of the outermost compartments. As shown in FIGS. 1 and 4, the top portion includes triangular recess above the through holes which receive correspondingly shaped triangular reinforcing sections 79 at opposite ends of connecting straps 72. Sections 79 form internal latching pockets 80 within which is received the hook.

The projectile compartments 18 formed in the above described molded base may further include a groove in the inner walls adapted to receive a self-latching mechanism for retaining the projectiles in the molded base. In its simplest form, the latching mechanism may take the form of a spring lever element having an extension at one end beneath the base of a container and a pull toggle or handle at the opposite end with the spring lever exerting a frictional biasing force between the projectile casing and compartment wall when the latch mechanism is pushed into the locking position. A guide screw in the wall may restrain the latch mechanism for limited movement within the compartment.

Referring to FIG. 4, molded base 11 is seen to have reinforcing plates 24 positioned within the transverse recesses 22 in the base surface 12. Steel frame 30 is shown assembled to the tapered top section 16 of the molded base. Cover 32 attaches to the steel frame and molded base assembly by the latching device 34 which may take the form of the latching device shown and described in U.S. Pat. No. 4,538,723, the subject matter of which is hereby incorporated by reference. Each reinforcing plate 24 includes a pair of tension rods 40 welded or otherwise fastened to and extending upward from the inner surface of the reinforcing plates. Each tension rod 40 extends through a pair of through holes, one (82) at the bottom of the molded base 11 and one (84) at the top of the molded base so that its threaded end extends into the latching pockets 80 within the steel frame. The tension rods 40 have threaded ends over which is passed a protective force distributing washer 44. A fastener, such as a nut 46, draws the reinforcing plates 24 and the steel frame tightly together around the molded base 11.

The steel frame 30 is wedge shape in cross-section as shown in FIG. 4, to accommodate the tapered top section 86 of the molded base 11. Due to the fact that the plastic molded base 11 and the steel, of the steel frame 30 and tension rods 40 have substantially different coefficients of thermal expansion, there will be a considerable difference in the expansion or contraction between the plastic elements and the steel elements. The wedge shaped cross-section of the mating steel frame 30 and top section 86 allows the plastic to move slightly within the frame to compensate for the difference in expansion.

During vertical lifting of the battlefield magazine by the lifting lugs 52, the weight of the battlefield magazine is transmitted down through the latching device 34, into the steel frame 30 down through the tension rods 40 and onto the reinforcing plates 24 which are secured to the steel frame by the tension rods 40 and the fasteners 46. In this way, the plastic body is supported from underneath. When the container is lifted horizontally by lugs 66, the wrap around steel frame provides structural support from underneath. Lugs 66 and 36 together with lugs 52 provide six (6) lifting points enabling a high degree of handling stability when lifting the magazine in its horizontal position. The four lifting lugs 52 provide four (4) lifting points for lifting the magazine in its vertical position. The above described construction provides proper load distribution, structural strength and added support to the molded base during lifting in both the horizontal and vertical positions.

Having described the preferred embodiment of an improved battlefield magazine in accordance with the present invention, it is recognized that other modifications, variations and changes will suggest themselves to those skilled in the art in view of the teachings set forth herein which embody the true spirit of the present invention. It is therefore to be understood that the foregoing description is not intended to be limiting in nature and resort should be made to the appended claims to determine the full scope of the invention.

What is claimed is:

1. A battlefield magazine for transporting and storing projectiles comprising:

a molded base unit having a base surface including two parallel transverse recesses, a storage section comprising a plurality of storage compartments for receiving a corresponding plurality of projectiles, and a top section having inwardly tapered sides, said plurality of projectile storage compartments each having a circular cross-section, parallel center lines, and a length and transverse dimension to be operable to hold a projectile with at least one-half of its ogives extending above a top surface of the top section of the molded base unit;

a wrap-around steel frame surrounding the top section of the molded base, said steel frame having a tapered cross-section adapted to abut the inwardly tapered sides of the top section;

two reinforcing plates each disposed in one of said transverse recesses on the base surface of the molded base unit, each said reinforcing plates including a pair of tension rods extending through said base and fastening means connected to the ends of said rods for drawing the reinforcing plates and steel frame tightly together around the molded base, said fastening means being placed on the ends of the tension rods.

2. A battlefield magazine as set forth in claim 1 further including a cover for enclosing the front one-half of the ogives of the projectiles extending out from the storage compartments, said cover having latching means for locking said cover to the frame and lifting means connected to said latching means arranged for transferring lifting forces to said frame and reinforcing plates.

3. The battlefield magazine of claim 1 wherein said wrap-around steel frame is an open rectangular frame member including a pair of spaced parallel straps within the frame and connecting opposite sides of the frame.

4. The battlefield magazine of claim 1 wherein said wrap-around frame further includes lifting lugs protruding from the sides for providing lifting points on one side of said magazine.

5. The battlefield magazine of claim 4 further including lug receiving recesses in the wrap-around frame on the sides opposite the lifting lugs of the frame for receiving lifting lugs of an adjacent stacked battlefield magazine.

6. The battlefield magazine of claim 2 wherein said cover comprises a latching device pivotally attached at one end within the cover and having a hook end portion at its other end adapted to hook into the steel frame to thereby attach the cover to the steel frame and molded base assembly.

7. The battlefield magazine according to claim 6 wherein said cover further includes a pair of handles, each having a gripping member disposed above the cover and a pair of spaced latching arms extending within the cover, each said arm having a cam member for engaging the hook end of an associated latching device, each said handle being movable between a first carrying position where said gripping members are spaced from said cover and a second latching position where said cam member engages said hook end of an associated latching device for hooking the hook end portion into the steel frame.

8. The battlefield magazine according to claim 1 further comprising a latching mechanism in each storage compartment for retaining the projectiles in the molded base.

9. A battlefield magazine for transporting a plurality of projectiles comprising:

a molded base having a plurality of cylindrical storage compartments for receiving back portions of a plurality of projectiles, one projectile adapted to be positioned in each compartment;

a wrap-around steel open frame member having internal reinforcing straps connecting a pair of opposite sides, said frame member being disposed about the molded base at one end for providing structural strength and support to the molded base;

a cover adapted to be attached to the steel frame and molded base assembly for enclosing the ogives of the projectiles extending out from the front of the molded base; reinforcing means disposed against another end of said molded base; and means for drawing the reinforcing means and steel frame tightly together around the molded base.

10. The battlefield magazine of claim 9 wherein said projectile storage compartments each are of circular cross-section and have a length and transverse dimension operable to hold a projectile with at least one-half of the ogives of the projectiles extending out from the front surface of the molded base, and parallel outer lines.

11. The battlefield magazine of claim 10 wherein said wrap-around steel frame comprises an open frame member and includes a pair of parallel tension straps for connecting opposite sides of the frame member for added structural strength; said straps having latching pockets disposed at the points of connection between the tension straps and the sides of the frame member for receiving the hook end of a latching device disposed within the cover.

12. The battlefield magazine as set forth in claim 11 wherein said steel frame includes lifting lugs extending from one of the opposite sides and frame recesses in the other of said opposite sides, said recesses being disposed for receiving lifting lugs from a second battlefield magazine to accomplish positive indexing during stacking of multiple battlefield magazines.

13. The battlefield magazine of claim 11 wherein said cover comprises a pair of handles, said handles being movable between a first raised position to allow removal of the cover and a second lowered position wherein said cover is locked to said magazine; and said latching device being pivotally attached at one end to the inner surface of the cover and having its hook end disposed within a latching pocket, said handle adapted to engage said hook end when said handle is in said second lowered position to force said hook end into a cover locking position.

14. The battlefield magazine of claim 9 wherein said reinforcing means comprises two reinforcing plates each positioned within a transverse recess on a back surface of the molded base, said reinforcing plates each having a pair of tension rods extending through the molded base and the steel frame and further including locking means attached to said rods for drawing the steel frame and the reinforcing plates tightly around the molded base.

15. The battlefield magazine of claim 13 wherein each said reinforcing plates further include a lifting lug protruding from one end of each reinforcing plate for providing a lifting point and a recess end of each reinforcing plate opposite the lifting lug, for receiving a lifting lug from a second battlefield magazine to allow positive indexing during horizontal stacking of battlefield magazines.

16. A battlefield magazine for transporting a plurality of projectiles comprising:

a molded base having a plurality of cylindrical storage compartments for receiving back portions of a plurality of projectiles, one projectile adapted to be positioned in each compartment;

said projectile storage compartments each being of circular cross-section and having a length and transverse dimension operable to hold a projectile with at least one-half of the ogives of the projectiles extending out from the front surface of the molded base, and parallel outer lines;

a wrap-around steel frame disposed about the molded base at one end for providing structural strength and support to the molded base; said wrap-around steel frame comprising an open frame member having a pair of parallel tension straps for connecting opposite sides of the frame member for added structural strength; said straps having latching pockets disposed at the points of connection between the tension straps and the sides of the frame member for receiving the hook end of a latching device disposed within the cover;

a cover adapted to be attached to the steel frame and molded base assembly for enclosing the ogives of the projectiles extending out from the front of the molded base;

reinforcing means disposed against another end of said molded base; and means for drawing the reinforcing means and steel frame tightly together around the molded base.

17. The battlefield magazine as set forth in claim 16 wherein said steel frame includes lifting lugs extending from one of the opposite sides and frame recesses in the other of said opposite sides, said recesses being disposed for receiving lifting lugs from a second battlefield magazine to accomplish positive indexing during stacking of multiple battlefield magazines.

18. The battlefield magazine of claim 16 wherein said cover comprises a pair of handles, said handles being movable between a first raised position to allow removal of the cover and a second lowered position wherein said cover is locked to said magazine; and said latching device being pivotally attached at one end to the inner surface of the cover and having its hook end disposed within a latching pocket, said handle adapted to engage said hook end when said handle is in said second lowered position to force said hook end into a cover locking position.

19. The battlefield magazine of claim 16 wherein said reinforcing means comprises two reinforcing plates each positioned within a transverse recess on a back surface of the molded base, said reinforcing plates each having a pair of tension rods extending through the molded base and the steel frame and further including locking means attached to said rods for drawing the steel frame and the reinforcing plates tightly around the molded base.

20. The battlefield magazine of claim 18 wherein each said reinforcing plates further include a lifting lug protruding from one end of each reinforcing plate for providing a lifting point and a recess end of each reinforcing plate opposite the lifting lug, for receiving a lifting lug from a second battlefield magazine to allow positive indexing during horizontal stacking of battlefield magazines.

* * * * *